US005330586A

United States Patent [19]

Komatsubara et al.

[11] Patent Number: 5,330,586

[45] Date of Patent: Jul. 19, 1994

[54] METHOD OF PRODUCING GRAIN ORIENTED SILICON STEEL SHEET HAVING VERY EXCELLENT MAGNETIC PROPERTIES

[75] Inventors: Michiro Komatsubara; Yasuyuki Hayakawa; Katsuo Iwamoto; Makoto Watanabe; Toshito Takamiya, all of Chiba, Japan

[73] Assignee: Kawasaki Steel Corporation, Japan

[21] Appl. No.: 905,915

[22] Filed: Jun. 29, 1992

[30] Foreign Application Priority Data

Jun. 27, 1991 [JP] Japan ..... 181551

[51] Int. Cl.[5] ..... H01F 1/04

[52] U.S. Cl. ..... 148/111; 148/113

[58] Field of Search ..... 148/111, 113

[56] References Cited

U.S. PATENT DOCUMENTS

| | | | |
|---|---|---|---|
| 4,202,711 | 5/1980 | Littmann et al. | 148/111 |
| 4,251,296 | 2/1981 | Thornburg et al. | 148/120 |
| 5,039,359 | 8/1991 | Yoshitomi et al. | 148/111 |

*Primary Examiner*—John P. Sheehan
*Attorney, Agent, or Firm*—Austin R. Miller

[57] ABSTRACT

A method of producing a grain oriented silicon steel thin sheet having excellent magnetic properties. A silicon steel slab containing Cu, Se and Sb as inhibitor-forming elements is hot rolled to form a hot-rolled sheet, followed by cold rolling at least twice including intermediate annealing to form a cold-rolled sheet having a final thickness of about 0.10 to 0.25 mm, decarburization and primary recrystallization annealing, and then final finish annealing. The temperature of the material to be rolled on the inlet side of the hot finish rolling mill is about 1000° to 1150° C. the surface temperature of the work rolls of the first stand of the hot finish rolling mill immediately before contact with the material to be rolled is about 100° C. or less the total rolling reduction of the hot finish rolling is about 93 to 97%, the intermediate annealing is effected at a temperature of about 900° to 1050° C. within a time of about 50 seconds, and the rolling reduction of the final cold rolling is about 50 to 80%.

4 Claims, 3 Drawing Sheets

METHOD OF PRODUCING GRAIN ORIENTED SILICON STEEL SHEET HAVING VERY EXCELLENT MAGNETIC PROPERTIES

BACKGROUND OF THE INVENTION

1. Field of the Invention

This invention relates to a method of producing high magnetic flux density grain oriented silicon steel sheets having excellent iron loss properties, and more particularly relates to a method of producing grain oriented silicon steel sheets having a thickness of about 0.10 to 0.25 mm in which iron loss is significantly and advantageously improved without decreasing magnetic flux density.

2. Description of the Related Art

Grain oriented silicon steel sheets are mainly used as iron cores for transformers and other electrical devices, and accordingly need to have excellent magnetic characteristics, particularly low iron loss as exemplified by the $W_{17/50}$ value.

It is important for this purpose to highly align the <100> orientation of the secondary recrystallized grains in the steel sheet in the rolling direction. It is also necessary to decrease the amounts of impurities and precipitates in the steel as much as possible. In consideration of the above requirements, iron loss has been improved from year to year. In recent years a thickness of 0.23 mm in a sheet product having a $W_{17/50}$ of 0.90 W/kg or less has been obtained.

However, the demand strongly tends to request electrical machinery and apparatus having still further reduced power loss in view of the current energy crisis. For this purpose, it is important to develop grain oriented silicon steel sheets having much lower iron loss as a core material than ever before.

In general, many fundamental techniques are known for reducing the iron loss of grain oriented silicon steel sheets. These include metallurgical methods such as increasing the Si percentage, thinning the sheet product, finely dividing the secondary recrystallized grains, reducing the amounts of impurities, highly aligning the secondary recrystallized grains of the ( 100 ) [100] orientation, and the like.

However, with regard to the above methods, increasing the percentage of Si is unsuitable for industrial production processes because an Si content over 4.5 wt % significantly deteriorates cold-rolling workability.

On the other hand, various methods have been proposed such as thinning the sheet product. For example, Japanese Patent Laid-Open Nos. 58-217630 and 59-126722 disclose a method in which Sn and Cu are added to a grain oriented silicon steel sheet containing AlN as an inhibitor to obtain a product having a thickness of 0.15 to 0.25 mm. Japanese Patent Laid-Open Nos. 62-167820, 62-167821 and 62-167822 disclose a method in which the average grain size of a grain oriented silicon steel sheet containing MnSe and MnS as inhibitors is adjusted to the range from 1 to 6 mm after secondary recrystallization to obtain a product having a thickness of 0.15 to 0.25 min.

However, addition of Sn and Cu to a grain oriented silicon steel sheet containing AlN as a main inhibitor produces a relatively high magnetic flux density, but produces a $W_{17/50}$ value of 0.85 to 0.90 W/kg. As shown in Table 5 of Japanese Patent Laid-Open No. 59-126722, this cannot be said to be a satisfactory value. Moreover, it is disadvantageous that since the proper rolling reduction of final cold-rolling exceeds 80% in the production of a grain oriented silicon steel sheet containing AlN as a main inhibitor, when the thickness ,of the product sheet-is decreased, secondary recrystallization becomes unstable, and the probability of producing a favorable iron loss is significantly decreased.

On the other hand, the method of thinning grain oriented silicon steel sheets containing MnSe and MnS as inhibitors and decreasing the sizes of the crystal grains therein causes the magnetic flux density to be inferior to that of the grain oriented silicon steel sheet containing AlN as a main inhibitor, but this method is excellent in regard to refining the crystal grains. Therefore, this method provides an improved iron loss, for example, a $W_{17/50}$ of 0.83 to 0.88 W/kg shown in Table 2 of Japanese Patent Laid-Open No. 62-167820. However, it cannot be said that the level of the iron loss value is a satisfactory value. This method also has the problem of instability in producing materials with low iron loss.

Further, in order to highly align the (110) [001] orientation of the secondary recrystallized grains, it is necessary to carry out rapid secondary recrystallization while sufficiently inhibiting the growths of normal grains. Adding Cu to steel is well known as a method of increasing inhibition. For example, Japanese Patent Publication No. 48-17688 discloses the technique of increasing inhibition by adding 0.10 to 0.30% Cu and moving MnTe to the grain boundaries. Japanese Patent Laid-Open No. 50-15726 discloses the technique of relaxing the limitation of hot-rolling conditions related to the precipitate of an inhibitor by decreasing the melting temperature of the inhibitor in slab heating by using manganese copper sulfide containing 0.1 to 0.5 % Cu as an inhibitor. Japanese Patent Publication No. 54-32412 discloses the technique of improving magnetic flux density by adding 0.2 to 1.0 % Cu or Ni so as to rationalize the rolling reduction and final finish annealing. Japanese Patent Laid-Open No. 61-12822 discloses the technique of increasing inhibition by adding 0.02 to 0.20 % Cu and precipitating $(Cu, Mn)_{1.8}S$ fine grains as an inhibitor, thereby improving the magnetic properties. Japanese Patent Publication No. 54-32412 discloses that a very high magnetic flux density and favorable iron loss can be obtained by adding both Cu and Sb to a grain oriented silicon steel material and secondarily recrystallizing the material at 800° to 950° C.

The effect of addition of Cu to steel is caused by the function of the inhibitor in steel to increase the inhibition. This is due to the fine dispersion and precipitation resulting from the change to $Cu_{2-x}Se$ of the type of the inhibitor precipitated and the control of deterioration in the inhibition in a steel surface portion. The deterioration of inhibition in the steel surface portion is the most critical problem in actual production processes in factories. The addition of Cu to steel is extremely effective because it can avoid deterioration and maintain the inhibition in the surface layer.

The demand for increasing inhibition in the surface layer of a steel sheet is increased with a decrease in the thickness of the steel sheet. The use of Se as an inhibitor element in place of S and the addition of Sb to steel are known as means for supplementing the function of the Cu addition and increasing inhibition. Namely, the use of Se causes the precipitates of CuSe as an inhibitor which is more stable than a CuS as an inhibitor with respect to the decomposition of the inhibitor in the surface layer of the steel sheet, thereby maintaining inhibitor in the surface layer of the steel sheet. The addition of Sb causes segregation of Sb on the surface of the steel sheet and segregation around $Cu_{2-x}Se$, thereby further inhibiting the decomposition of $Cu_{2-x}Se$ used as an inhibitor.

Since the use of Se as an inhibitor element in place of S and the addition of Sb are effective for preventing the deterioration in inhibition in the surface layer portion of the steel sheet, as the addition of Cu, they are generally used in the industrial field.

However, it was found that there is a problem that the effects of Cu addition deteriorate as the thickness of a sheet material is further decreased. This makes it difficult to comply with the strong demand for further decreasing the iron losses. For example, Japanese Patent Laid-Open No. 61-159531, discloses embodiments of steel plates each containing 0.04 to 0.19 % Cu and respectively having a final thicknesses of 0.225 and 0.175 mm. However, the embodiments respectively have magnetic flux densities and iron losses which are $B_{10}=1.87T$ ($B_8$=about 1.85T) and $W_{17/50}=0.94$ W/kg and $B_{10}=1.88T$ ($B_8=1.86T$) and $W_{17/50}=0.90$ W/kg. The effect of the decrease in the thickness of each of the steel sheets was not sufficiently obtained.

SUMMARY OF THE INVENTION

Accordingly, the object of the present invention is to provide a better method of producing a grain oriented silicon steel sheet having excellent magnetic properties even when the steel sheet is so thin as to have a final thickness of about 0.10 to 0.25 mm.

The lower limit of the final thickness of about 0.10 mm is given by the reason that with a thickness less than about 0.10 mm, even the method of the invention may not inhibit deterioration of inhibition, due to an increase in size of the inhibitor in the steel sheet surface layer, producing defective secondary recrystallization and deteriorating magnetic properties.

We have observed in detail the condition of the inhibitor which is present in the surface layer portion of a steel sheet when the thickness of the steel sheet is decreased. Specifically, we, have observed particle dispersion characteristics of inhibitors precipitated in the surface layer portion of hot-rolled steel sheets consisting of 3.25 % Si, 0.07 % Mn, 0.2% Cu, 0.02 % Se, 0.02 % Sb and the balance substantially composed of Fe. A nonuniform dispersion state was observed in which very fine particles and large particles were mixed. It was also found that a steel sheet having a final thickness in a final finishing annealing step after various heat treatments and cold-rolling has a particle distribution in which even the frequency rate of occurrence of fine particles as shown in FIG. 1 is decreased. This shows that fine particles gradually coalesce into large particles because of the step of cold rolling, and reveals that a phenomenon called Ostwald growth readily takes place as the thickness of the steel sheet is decreased. An increase in size of the inhibitor in the surface layer of the steel sheet occurs before final finishing annealing and reveals that control in the surface layer deteriorates. Thus, a product having good magnetic properties cannot be obtained.

It was thus discovered that one root of the problem resides in the size distribution of the inhibitor precipitated during hot-rolling, particularly the inhibitor precipitated in the surface layer of the steel sheet. On the basis of this discovery, we have found that a uniform fine size distribution is effective for improving sheet magnetic characteristics. This has been confirmed by various experiments relating to hot rolling. As a result, it was found that it is extremely effective for solving the problem to control the temperature of the material to be rolled at the inlet side of a hot finish rolling mill, and to control the surface temperature of the work roll of the rolling mill, particularly the surface temperature of a portion of the work roll of the first stand immediately before contact with the material to be rolled, to control the total rolling reduction of hot finish rolling, and to control the temperature and time of intermediate annealing. This discovery has resulted in the creation of the present invention.

The present invention provides a method of producing a grain oriented silicon steel thin sheet having excellent magnetic properties, comprising the steps of hot-rolling a silicon steel slab containing Cu, Se and Sb as inhibitor-forming components to form a hot-rolled sheet, cold-rolling at least twice with intermediate annealing to form a cold-rolled sheet having a final thickness of about 0.10 to 0.25 mm, decarburizing, primary recrystallization annealing, and then final finish annealing. The method is characterized by the following important limitations:

(a) The temperature of the material to be rolled on the inlet side of the hot finish rolling mill is about 1000° to 1150° C.

(b) The surface temperature of the work roll of the first stand of the hot finish rolling mill immediately before contact with the material to be rolled is about 100° C. or less.

(c) The total rolling reduction of the hot finish rolling step is about 93 to 97%.

(d) Intermediate annealing is effected at a temperature of about 900° to 1050° C. for 50 seconds.

(e) The rolling reduction of final cold-rolling is about 50 to 80%.

It is also useful for performing the invention that the rolling reduction of the first pass of hot finish rolling is at least about 40 %.

DETAILED DESCRIPTION OF THE INVENTION

Figure 1:
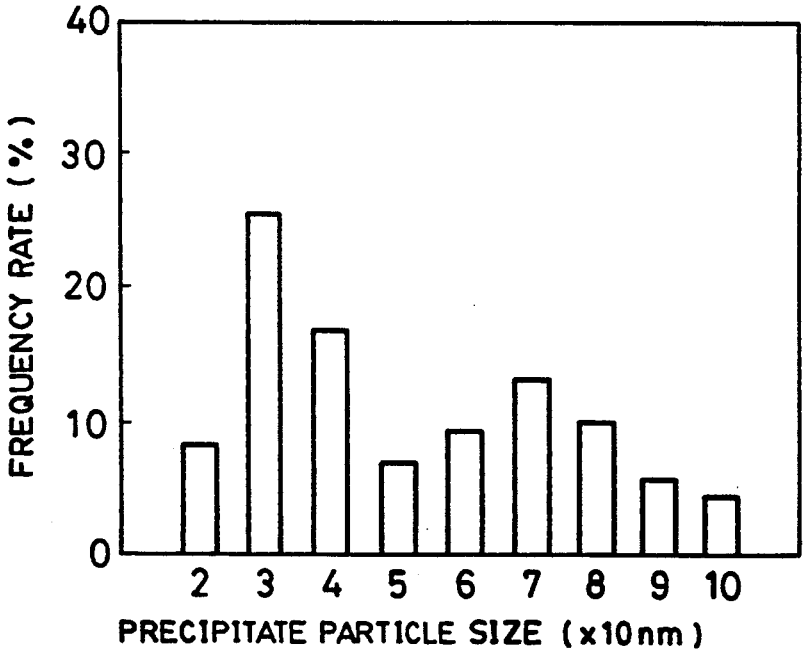
FIG. 1 is a graph showing precipitated particle size distribution of an inhibitor in the surface layer portion of a steel sheet of a conventional hot-rolled coil.

In the present invention, a grain oriented silicon steel slab obtained by continuous casting or ingot making and blooming is used as the silicon-containing steel slab as the starting material. However, a slab obtained by continuous casting and then blooming can also be used.

The composition of the slab is preferably within the following ranges:

C: about 0.01 to 0.10%

C is a useful component for forming a uniform fine texture during hot rolling and cold rolling and development of Goss orientation, and the C content is preferably at least about 0.01%. However, since a C content over about 0.10% produces disorder of Goss orientation, the upper limit is preferably about 0.10%.

Si: about 2.0 to 4.5%

Si significantly contributes to an increase of resistivity of the steel sheet and a decrease of the iron loss thereof. With a Si content over about 4.5%, the cold-rolling workability deteriorate, while with a Si content less than about 2.0%, the resistivity is decreased, and the crystal orientation is made random due to $\alpha$-$\gamma$ transformation during final high-temperature annealing which is harmful for secondary recrystallization and purification. Since, in both cases, the effect of improving iron loss cannot be sufficiently obtained, Si content is preferably within the range of about 2.0 to 4.5%.

Mn: about 0.02 to 0.12%

The Mn content must be at least about 0.02% for preventing hot embrittlement. However, if the content is excessively high, the magnetic characteristics deteriorate. It is thus preferable to set the upper limit to about 0.12%.

Cu, Se and Sb which are segregation type elements are used as necessary inhibitor forming elements.

With a Cu content less than about 0.03%, $Cu_{2-x}Se$ is insufficiently precipitated, while with a Cu content over about 0.30%, large particles are precipitated, without the function as an inhibitor. The Cu content is thus preferably within the range of about 0.03 to 0.3%.

The Se content must be at least about 0.01% for precipitating $Cu_{2-x}Se$. If the content exceeds about 0.06%, the size of the precipitated particles is increased, with deterioration in the effect of Se. It is thus preferable that the Se content is with the range of about 0.01 to 0.06%.

Sb is a necessary component because it segregates at grain boundaries and has the effect of controlling grain growth. It segregates on the surface of the steel sheet and has the effect of preventing deterioration of the inhibitor in the surface layer, and it segregates around the precipitates and has the effect of preventing the decomposition of $Cu_{2-x}Se$. The Sb content must be at least about 0.005% for manifesting these effects. However, if the Sb content exceeds about 0.20%, the steel sheet is made brittle and cannot be rolled. It is thus preferable to set the Sb content to about 0.005 to 0.20%.

Although S is a harmful element because it is precipitated as $Cu_{1-x}S$ and deteriorates the function of $Cu_{2-x}Se$, it is inevitably mixed as impurities. Since the removal of S requires high cost and much effort, it is preferable to decrease the S content to about 0.007% or less which causes little actual damage.

Although Al joins N to form an AlN inhibitor, it is a harmful inhibitor in the invention, and the Al content is preferably decreased to about 0.003% or less, as much as possible.

In addition, since Sn, Cr, Ge, Mo, Bi and P other than the above elements Cu, Se and Sb are also suitable as inhibitor forming components, small amounts of these other elements may be included. The preferable ranges of the elements Sn, Cr, Ge, Mo, Bi and P are as follows:

Sn, Cr: 0.01 to 0.15%

Ge, Mo, Te and Bi: 0.005 to 0.1%

P: 0.01 to 0.2%

These inhibitor components can be used singly or in combination of one or more.

A slab having the above-described composition is preferably heated by use of the usual gas combustion furnace or by heating with a gas combustion furnace and then by an induction heater or direct conduction furnace to perform solution heat treatment of the inhibitor. The thus-obtained product is then roughly rolled into a sheet bar. At this time the thickness of the sheet bar must be strictly controlled to the initial thickness calculated by the thickness of the hot-rolled coil and the range of the total rolling reduction of finish rolling in the present invention.

We have investigated the cause of nonuniform size distribution of inhibitors in a steel sheet surface layer after hot rolling, as shown in FIG. 1. As a result, it was found that if the cooling speed of the surface layer of the steel sheet is decreased during hot finish rolling, since time and temperature are provided for the growth of the inhibitor precipitated in the initial stage, large particles of the inhibitor are inevitably produced. In other words, rapid cooling is necessary to precipitate fine particles of the inhibitor uniformly. In order to cool the surface layer of the steel sheet rapidly, it is important to perform the hot finish rolling step under the conditions indicated below.

The temperature of the material to be rolled on the inlet side of the hot finish-rolling mill is within the range of about 1000° to 1150° C. If the temperature of the material on the inlet side is less than about 1000° C. the surface temperature of the steel sheet is sufficiently decreased, while if such temperature exceeds about 1150° C., a temperature drop necessary for and sufficient to precipitate fine particles of the inhibitor cannot be obtained due to excessive inflow of heat which exceeds the heat removing ability of the work roll in the first pass of the hot finish rolling mill. The temperature of the material to be rolled on the inlet side of the hot finish rolling mill is thus controlled within the range of about 1000° to 1150° C. The adjustment of the temperature of the material to be rolled on the inlet side is realized by appropriately adjusting the thickness of the sheet bar, delaying the rolling start time or increasing the amount of water in a scale breaker on the inlet side so as to decrease the temperature. However, at the rear end of the coil where temperature decrease is a problem, the temperature is preferably secured by decreasing the amount of water in the scaler breaker, using gas in place of the water or positively heating.

The temperature of the work roll of the first stand of the hot finish rolling mill immediately before contact with the material to be rolled is about 100° C. or less. It is most important to control the surface temperature of the work roll of the first stand of the finish rolling mill. The inhibitor in the surface layer of the steel sheet can be uniformly and finely dispersed by removing heat via the work roll during the course of rolling. This effect cannot be obtained by usually decreasing the temperature of the steel sheet using cooling water after rolling.

During hot-rolling, the work roll is generally first heated by contact with the steel sheet and then decreased to the lowest temperature by contact with the backup roll and the intermediate roll and cooling with cooling water immediately before contact with the steel sheet. This cycle is repeated for a very short time. In a stationary cycle, the highest surface temperature of the work roll is about 500° to 700° C. and the lowest temperature attained by cooling is about 60° to 200° C. In the present invention the surface temperature of the work roll must be deceased by applying a large amount of roll cooling water. It is also effective to increase the diameter of the work roll. Although the surface temperature of the roll is generally measured by a contact thermometer, the surface temperature can also be measured simply on the basis of the generation of vapor during contact of the cooling water with the roll surface.

Since it is a matter of course that the surface of the steel sheet can also be rapidly cooled by decreasing the rolling speed during hot finish rolling, this method can be employed to the utmost. However, the method is preferably employed in a manner not to decrease the rolling speed lengthening the waiting time for hot finish rolling at the rear end of the coil. This causes a decrease of the temperature at the inlet side of the hot finish rolling step.

In addition, temperature decrease of the steel sheet during hot finish rolling can be aided by increasing the rolling reduction of the first pass in the hot finish rolling step to at least 40%, thereby enhancing the beneficial effects of the present invention. Namely, the function of the work roll in removing heat is improved by increasing the surface area of the steel sheet in contact with the work roller in the first path.

The total rolling reduction in the hot finish rolling step is strictly controlled to a value within the range of about 93 to 97%. If the rolling reduction is less than about 93% the thickness of the layer containing the finely and uniformly precipitated inhibitor on the surface of the steel sheet is unsatisfactory. On the other hand, if the rolling reduction exceeds about 97%, the texture of the hot-rolled steel sheet deteriorates and becomes disadvantageous for secondary recrystallization.

A hot-rolled sheet produced under the above conditions for hot-rolling is described below.

A slab made of the same material as that used in the experiment shown in FIG. 1 was roughly rolled to form a sheet bar having a thickness of 40 mm. At this time, the amount of water in the scale breaker on the inlet side of hot finish rolling was limited, and the amount of cooling water for the work roll of the first stand was increased. The pass of hot finish rolling was determined so that the thickness was on the order of 40 mm→25 mm→14 mm→7 mm →3 mm→2.0 mm. The total rolling reduction of hot finish rolling was 95%. The temperature at the inlet side of the hot finish rolling step was 1120° C. and the temperature of the work roll of the first stand immediately before contact with the material to be rolled was 75° C.

Figure 2:
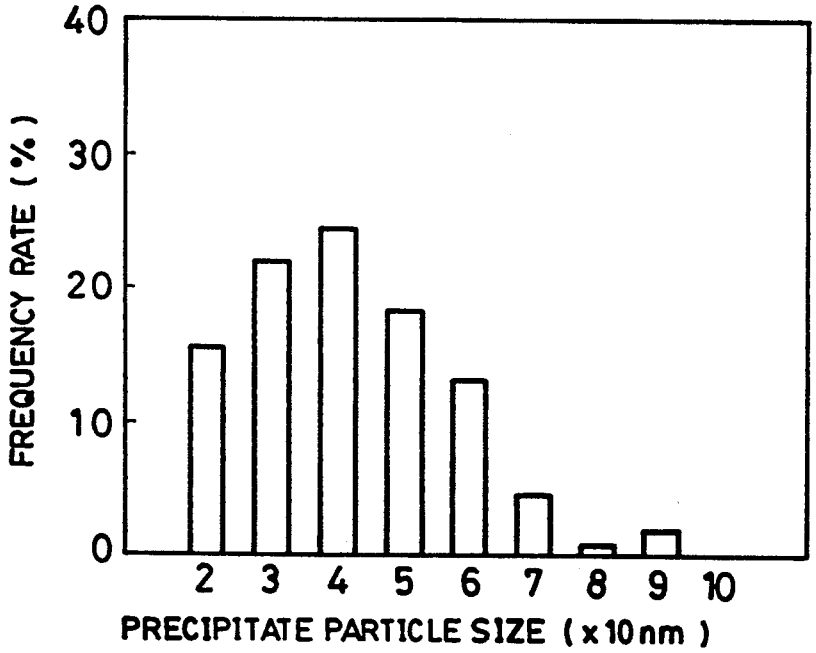
FIG. 2 is a graph showing precipitated particle size distribution of an inhibitor in the surface layer portion of a steel sheet of a hot-rolled coil obtained by hot rolling in accordance with the present invention.

FIG. 2 shows the size distribution of the inhibitor in the surface layer portion of the hot-rolled sheet obtained by the above process. An attempt was made to distribute fine precipitated particles uniformly with the size distribution shown in FIG. 2, as compared to the size distribution shown in FIG. 1. The inhibitor in the hot-rolled sheet had extremely good size distribution.

Hot-rolling in accordance with the above process enabled the inhibitor in the surface layer of the hot-rolled sheet of the coil obtained to be uniformly and finely precipitated. However, when a grain oriented silicon steel thin sheet is produced by using a hot-rolled coil, a problem is frequently produced with respect to deterioration of magnetic characteristics.

Figure 3:
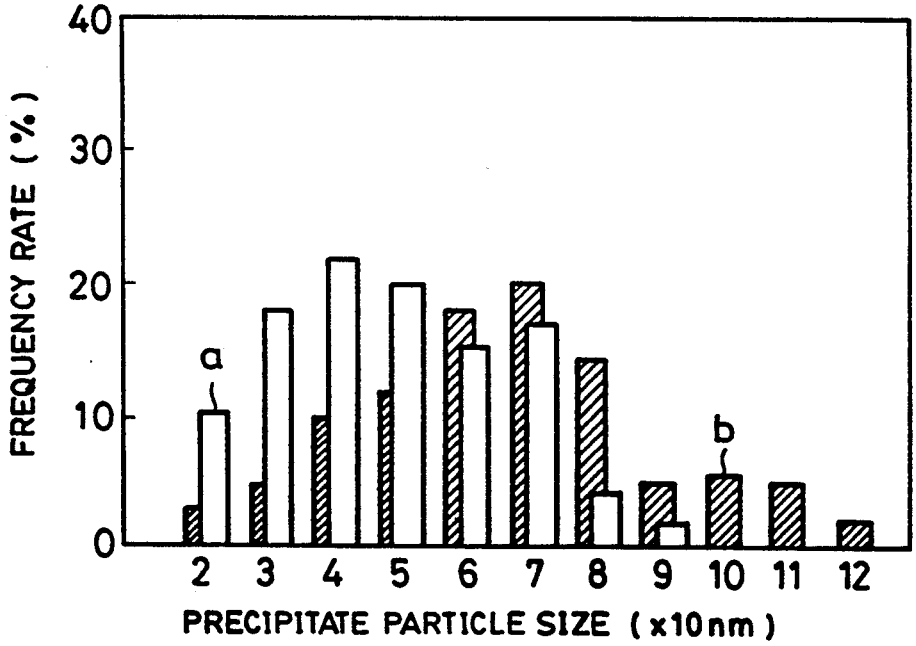
FIG. 3 is a graph showing time of intermediate annealing and precipitated particle size distribution of an inhibitor in the surface layer portion of a steel sheet after decarburization and primary recrystallization annealing.

As a result of examination of the size distribution of the inhibitor in the surface layer portion of the steel sheet after decarburization and primary recrystallization annealing, it was found that the average size of the inhibitor contained in the steel sheet, which showed deterioration of magnetic characteristics, is increased. It has been found as a result of our research that although the CuSe inhibitor provides strong inhibition because it is finely precipitated, the Ostwald growth readily occurs during intermediate annealing at a high temperature for a long time. FIG. 3 shows a comparison between the size distributions of the samples subjected to the same hot-rolling as that in the experiment shown in FIG. 2, cold-rolling of 60% and then annealing at 1000° C. for 30 seconds (a) and then annealing at 1000° C. for 2 minutes (b). It is apparent from FIG. 3 that the size of the precipitates is increased by annealing for a longer time, with deterioration of the control.

The sheet of the coil obtained after hot-rolling had a final thickness of about 0.10 to 0.25 mm after cold-rolling at least two times with intermediate annealing. However, intermediate annealing was effected at 900° to 1050° C. for 50 seconds or less in order to prevent an increase in the size of the inhibitor in the surface layer portion. If the annealing temperature is less than about 900° C. predetermined effects of recrystallization cannot be obtained, while if the annealing temperature exceeds about 1050° C., the size of the inhibitor is increased even by soaking for about 50 seconds or less. It is thus necessary for preventing an increase of the size of the inhibitor that the annealing be effected for about 50 seconds or less within the above temperature range. When these conditions are satisfied, improvement of the magnetic characteristics of products can be obtained.

It is also advantageous that the temperature rise speed of the intermediate annealing is higher, and the temperature rise is-preferably completed within about 1 minute or less in order to prevent an increase in the size of the inhibitor. In addition, if required, the hot-rolled coil is annealed for improving magnetic characteristics. This annealing is of course performed in accordance with the method embodying intermediate annealing. It is also effective for the present invention to use the known technique of partially decarburizing during intermediate annealing or precipitating fine carbide by quenching and aging.

The rolling reduction of subsequent final cold rolling is about 50 to 80%. With a rolling reduction of less than about 50%, the size of secondarily recrystallized grains is increased, and the iron loss deteriorates. With a rolling reduction over about 80%, defective secondary recrystallization brings about significant deterioration in flux density. It is thus necessary that the rolling reduction is held to about 50 to 80%.

The steel sheet cold-rolled to its final thickness is then subjected to decarburization and primary recrystallization annealing. After an annealing separation agent is then coated on the surface of the steel sheet, the steel sheet is subjected to final finish annealing at about 200° C. for secondary recrystallization and purification and then coated with an insulating coating to form a product.

Japanese Patent Laid-Open No. 58-42727 discloses the investigation of proper conditions of hot-rolling of grain oriented silicon steel containing Cu and S and shows that it is preferable that the temperatures of the head portion, the central portion and the tail portion of the hot-rolled sheet at the outlet of finish rolling are 900° to 1050° C. and 950° to 1150° C. respectively However, low iron loss cannot easily be stably obtained by this method. Japanese Patent Laid-Open No. 54-120214 discloses the technique of activating the recrystallization of the texture of grain oriented silicon steel containing an unspecified inhibitor by providing a rolling pass having a rolling reduction of at least 30% within the temperature range of 960° to 1190° C. in any one of the rolling steps of hot-rolling. However, the type of the inhibitor and the precipitation time thereof are not considered.

The following Examples, are illustrative and are not intended to define or limit the scope of the invention, which is defined in the appended claims.

EXAMPLE 1

A slab having each of the compositions A to Q shown in Table 1 was heated at a temperature of 1420° C. and then roughly rolled to form a sheet bar having a thickness of 40 mm. After waiting for 20 seconds, the sheet bar was subjected to finish rolling to thicknesses 40 mm→20 mm→12 mm→7 mm→5 mm→3 mm→2.5 mm→2.0 mm in respective rolling passes by using a hot finish rolling mill comprising 7 stands. At this time, the temperatures of the head portion and the tail portion of the coil on the inlet side of hot finish rolling were 1145° C. and 1080° C., respectively. The total rolling reduction of hot finish rolling was 95% and the rolling reduction of the first pass was 50%. In addition, the surface temperatures of the upper roll and the lower roll of the work roll of the first stand immediately before contact with the material to be rolled were 68° C. and 82° C., respectively. The amount of water for cooling the work rolls of the first stand was twice the usual amount.

Each of the resultant hot-rolling coils was then annealed at 1000° C. for 30 seconds, cold-rolled to a thickness of 0.55 mm and then subjected to intermediate annealing at 975° C. for 30 seconds. The coil was then subjected to second cold rolling to a final thickness of 0.20 mm, and then subjected to decarburization and primary recrystallization annealing. After an annealing separation agent consisting of MgO as a main component was coated on the sheet, the sheet was wound into a coil, subjected to secondary recrystallization during temperature rise, subjected to final finish annealing at 1200° C. for 10 hours and then coated with an tension coating to form a product.

The magnetic properties of each of the thus-obtained products are shown in Table 2.

Although the product obtained in each Comparative Example P and Q had a $W_{17/50}$ value of at least 0.92 W/kg, the product obtained in each of Examples A to O had values of 0.80 W/kg or less.

TABLE 2

| Slab No. | Magnetic Properties $B_8$ (T) | $W_{17/50}$ (W/kg) |
|---|---|---|
| A | 1.923 | 0.80 |
| B | 1.922 | 0.79 |
| C | 1.920 | 0.77 |
| D | 1.923 | 0.78 |
| E | 1.926 | 0.77 |
| F | 1.924 | 0.78 |
| G | 1.920 | 0.78 |
| H | 1.934 | 0.76 |
| I | 1.928 | 0.77 |
| J | 1.923 | 0.76 |
| K | 1.924 | 0.78 |
| L | 1.927 | 0.77 |
| M | 1.925 | 0.77 |
| N | 1.924 | 0.76 |
| O | 1.933 | 0.76 |
| P | 1.895 | 0.92 |
| Q | 1.890 | 0.97 |

Note)
A to O: Examples of the invention
P and Q: Comparative Examples

EXAMPLE 2

A slab having the composition B shown in Table 1 was heated to a temperature of 1430° C. and roughly rolled to a thickness of 40 mm to form a sheet bar. The sheet bar was then subjected to hot finish rolling using a hot finish rolling mill comprising 7 stands with the same pass schedule under cooling by the same work roll as those in Example 1 with the exception that the rolling speed was decreased. The temperatures of the head and tail portions of the coil on the inlet side of finish rolling were 1175° C. and 930° C., respectively. The surface temperatures of the upper and lower sides of the head portion of the work roll of the first stand immediately before contact with the material to be rolled were 68° C. and 87° C. respectively The surface temperatures of the upper and lower sides of the tail portion were 65° C. and 83° C., respectively.

Portions of the hot-rolled sheet which respectively correspond to temperatures of 1175° C., 1145° C., 1100° C., 1050° C., 1000° C., 950° C. and 930° C. on the inlet side of finish rolling were collected and then subjected to cold-rolling by the same process as that in Example 1. The magnetic properties of each of the resultant steel sheets are shown in Table 3.

TABLE 1

| Slab No. | Composition (%) C | Si | Mn | P | Al | S | Se | Mo | Cu | Sb | Ge | Cr | Sn | Bi |
|---|---|---|---|---|---|---|---|---|---|---|---|---|---|---|
| A | 0.043 | 3.36 | 0.071 | 0.004 | 0.001 | 0.003 | 0.017 | tr | 0.08 | 0.025 | tr | 0.01 | 0.01 | tr |
| B | 0.040 | 3.29 | 0.068 | 0.003 | 0.001 | 0.002 | 0.020 | 0.010 | 0.15 | 0.020 | tr | 0.01 | 0.01 | tr |
| C | 0.039 | 3.34 | 0.073 | 0.004 | 0.002 | 0.004 | 0.022 | tr | 0.22 | 0.023 | tr | 0.01 | 0.01 | tr |
| D | 0.041 | 3.28 | 0.069 | 0.003 | 0.001 | 0.003 | 0.018 | tr | 0.18 | 0.026 | 0.014 | 0.01 | 0.01 | tr |
| E | 0.044 | 3.37 | 0.070 | 0.015 | 0.002 | 0.003 | 0.021 | tr | 0.23 | 0.022 | tr | 0.01 | 0.01 | tr |
| F | 0.038 | 3.35 | 0.071 | 0.003 | 0.002 | 0.003 | 0.019 | tr | 0.19 | 0.023 | tr | 0.08 | 0.02 | tr |
| G | 0.041 | 3.32 | 0.067 | 0.003 | 0.001 | 0.002 | 0.020 | tr | 0.12 | 0.024 | tr | 0.01 | 0.12 | tr |
| H | 0.040 | 3.34 | 0.069 | 0.004 | 0.001 | 0.002 | 0.021 | tr | 0.25 | 0.025 | tr | 0.02 | 0.02 | 0.008 |
| I | 0.036 | 3.31 | 0.074 | 0.005 | 0.001 | 0.003 | 0.022 | 0.013 | 0.22 | 0.027 | 0.007 | 0.01 | 0.01 | tr |
| J | 0.042 | 3.27 | 0.065 | 0.003 | 0.001 | 0.002 | 0.018 | 0.015 | 0.10 | 0.021 | tr | 0.01 | 0.15 | tr |
| K | 0.043 | 3.34 | 0.067 | 0.020 | 0.002 | 0.001 | 0.020 | 0.010 | 0.15 | 0.023 | tr | 0.01 | 0.01 | tr |
| L | 0.037 | 3.30 | 0.065 | 0.016 | 0.001 | 0.003 | 0.022 | 0.008 | 0.09 | 0.022 | 0.008 | 0.01 | 0.01 | tr |
| M | 0.041 | 3.28 | 0.072 | 0.003 | 0.002 | 0.002 | 0.023 | 0.012 | 0.14 | 0.026 | tr | 0.07 | 0.10 | tr |
| N | 0.039 | 3.25 | 0.070 | 0.004 | 0.001 | 0.001 | 0.020 | tr | 0.15 | 0.030 | 0.011 | 0.08 | 0.01 | tr |
| O | 0.042 | 3.31 | 0.068 | 0.006 | 0.001 | 0.002 | 0.019 | 0.010 | 0.19 | 0.025 | 0.013 | 0.01 | 0.01 | 0.005 |
| P | 0.040 | 3.30 | 0.069 | 0.005 | 0.002 | 0.003 | 0.020 | tr | 0.15 | tr* | tr | 0.01 | 0.01 | tr |
| Q | 0.042 | 3.32 | 0.065 | 0.003 | 0.001 | 0.017* | tr* | tr | 0.16 | 0.020 | tr | 0.01 | 0.01 | tr |

Note)
A to O: Examples of the invention
P and Q: Comparative Examples
*beyond the range of the invention Table 3 reveals that the products of Experiments Nos. 2 to 5 in which the temperature of a steel sheet on the inlet side of hot finish rolling was within the range of the present invention had excellent magnetic properties, as compared with the products of Experiment Nos. 1, 6 and in which the temperature was beyond the range of the invention.

TABLE 3

| Experiment No. | Temperature of Inlet Side of Hot Finish Rolling (°C.) | Temperature of First Stand Roll Upper/Lower (°C.) | Magnetic Properties $B_8$ (T) | Magnetic Properties $W_{17/50}$ (W/kg) |
|---|---|---|---|---|
| 1 | 1175* | 68/87 | 1.886 | 0.92 |
| 2 | 1145 | 70/92 | 1.922 | 0.81 |
| 3 | 1100 | 69/88 | 1.923 | 0.80 |
| 4 | 1050 | 66/85 | 1.925 | 0.80 |
| 5 | 1000 | 64/86 | 1.920 | 0.82 |
| 6 | 950* | 66/84 | 1.895 | 0.90 |
| 7 | 930* | 65/83 | 1.890 | 0.95 |

Note)
Experiment Nos. 2 to 5: Examples of the invention
Experiment Nos. 1, 6, 7: Comparative Examples
*beyond the range of the invention

EXAMPLE 3

A slab having the composition B shown in Table 1 was heated to 1420° C. and then roughly rolled to form sheet bars respectively having thicknesses of 20 mm, 35 mm, 45 mm and 60 mm. The resultant sheet bars respectively having the thicknesses of 20 mm and 35 mm were immediately subjected to finish rolling with the rolling schedule shown in Table 4 to form a hot-rolled coil having a thickness of 1.6 mm. The sheet bars respectively having thicknesses of mm and 60 mm were subjected to the same finish rolling after waiting for 10 seconds and 60 seconds, respectively. For each of the sheet bars, the amount of water in the scale breaker was adjusted so that the temperature was within the range of 1000° to 1150° C. The amount of cooling water for the work roll of the first stand was increased. The temperature of each of the sheet bars on the inlet side of finish rolling and the surface temperature of the work roll of the first stand immediately before contact with a material to be rolled are also shown in Table 4.

Each of the resultant hot-rolled coils was then annealed at 975° C. for 30 seconds, subjected to cold-rolling to a thickness of 0.40 mm and then annealed at 1000° C. for 20 seconds in a decarburization atmosphere so that the C content was decreased to about 0.030%. Each of the coils was then subjected to second cold-rolling to a final thickness of 0.15 mm, and then subjected to decarburization and primary recrystallization annealing in an atmosphere of wet hydrogen. After an annealing separation agent consisting of MgO as a main component was coated on each of the sheets, the sheet was wound into a coil, subjected to final finish annealing at 1200° C. for 10 hours including secondary recrystallization annealing at 850° C. for 50 hours, and then coated with a tension coating to form a product. The magnetic properties of each of the products obtained are also shown in Table 4.

Table 4 reveals that the products of Experiment Nos. 9 and 10 with the total rolling reduction of hot finish rolling within the range of the present invention have excellent magnetic properties, as compared with the products of Experiment Nos. 9 and 10 with the total rolling reduction beyond the range of the invention.

TABLE 4

| Experiment No. | Sheet Bar Thickness | Temperature on Inlet Side of Finishing Rolling (°C.) Head | Temperature on Inlet Side of Finishing Rolling (°C.) Tail | Tamperature of First Stand Roll (°C.) Upper/Lower | Hot Finish Rolling Schedule (mm) | Rolling Reduction of First Pass (%) | Total Rolling Reduction (%) | Magnetic Properties $B_8$ (T) | Magnetic Properties $W_{17/50}$ (W/kg) |
|---|---|---|---|---|---|---|---|---|---|
| 8 | 60 | 1145 | 1100 | 84/93 | 60→30→15→8→5→3→2→1.6 | 50.0 | 97.3* | 1.747 | 0.98 |
| 9 | 45 | 1140 | 1050 | 72/86 | 45→20→11→6→4→3→2→1.6 | 55.5 | 96.4 | 1.894 | 0.73 |
| 10 | 35 | 1122 | 1025 | 65/73 | 35→16→10→7→4→3→2→1.6 | 54.3 | 95.4 | 1.898 | 0.75 |
| 11 | 20 | 1100 | 1012 | 64/70 | 20→10→8→6→5→3→2→1.6 | 50.0 | 92.0* | 1.793 | 0.95 |

Note)
Experiment Nos. 9 and 10: Examples of this invention
Experiment Nos. 8 and 11: Comparative Examples
*beyond the range of the invention

EXAMPLE 4

Five slabs each having the composition D shown in Table 1 were heated to a temperature of 1430° C. and then roughly rolled to a sheet bar having a thickness of 40 mm. The sheet bars were respectively subjected to hot finish rolling in accordance with the finish rolling schedules I to V shown in Table 5 to form hot-rolled coils each having a thickness of 2.0 mm. The amount of water in the scale breaker on the inlet side was decreased, and the amount of cooling water for the work rolls was increased. The temperature on the inlet side of hot finish rolling and the surface temperature of the work roll of the first stand immediately before contact with the material to be rolled are also shown in Table 5.

Each of the resultant hot-rolled coils was then annealed at 1000° C. for 40 seconds, subjected to cold rolling to a thickness of 0.60 mm and then annealed at 1000° C. for 40 seconds in a decarburizing atmosphere so that the C content was decreased to about 0.035%, as well as being quenched to precipitate fine carbide. Each of the coils was subsequently subjected to second rolling to a final thickness of 0.23 mm, and subjected to decarburization and primary recrystallization annealing in an atmosphere of wet hydrogen. After an annealing separation agent consisting of MgO as a main component was coated on each of the sheets obtained, the sheet was wound into a coil, subjected to final finish annealing at 1200° C. for 10 hours including secondary recrystallization annealing at 850° C. for 50 hours and then coated with a tension coating to form a product.

The magnetic properties of each of the products obtained are also shown in Table 5.

Table 5 reveals that when the rolling reduction of the first pass of hot finish rolling is at least 40%, more excellent magnetic properties can be obtained.

TABLE 5

| Experiment No. | Temperature on Inlet Side of Finishing Rolling (°C.) Head | Tail | Tamperature of First Stand Roll (°C.) Upper/Lower | Hot Finish Rolling Schedule (mm) | Rolling Reduction of First Pass (%) | Total Rolling Reduction (%) | Magnetic Properties $B_8$ (T) | $W_{17/50}$ (W/kg) |
|---|---|---|---|---|---|---|---|---|
| 12 | 1144 | 1085 | 73/88 | 40→25→15→9→6→4→2.5→2.0 | 37.5 | 95.0 | 1.921 | 0.84 |
| 13 | 1140 | 1065 | 69/78 | 40→22→14→8→5→3→2.5→2.0 | 45.0 | 95.0 | 1.924 | 0.81 |
| 14 | 1145 | 1074 | 68/74 | 40→20→12→7→5→3→2.5→2.0 | 50.0 | 95.0 | 1.922 | 0.82 |
| 15 | 1142 | 1078 | 62/75 | 40→18→12→7→5→3→2.5→2.0 | 55.0 | 95.0 | 1.925 | 0.82 |
| 16 | 1140 | 1080 | 53/68 | 40→15→10→7→5→3→2.5→2.0 | 62.5 | 95.0 | 1.923 | 0.83 |

Note)
Experiment Nos. 12 to 16: Examples of this invention

EXAMPLE 5

A slab having the composition H shown in Table 1 was heated to a temperature of 1420° C. and then subjected to hot-rolling by the same method as that in Example 1 to form a hot-rolled coil having a thickness of 2.0 mm. The temperatures of the head and tail portions on the inlet side of hot finish rolling were 1135° C. and 1085° C., respectively. The surface temperature of the upper and lower sides of the work rolls of the first stand immediately before contact with the material to be rolled were 83° C. and 88° C. respectively. The resulting coil was then annealed at 1000° C. for 40 seconds, and then subjected to cold rolling to a thickness of 0.55 min. The coil was divided into 5 portions which were then respectively subjected to intermediate annealing at the temperatures and for the times shown in Table 6.

Each of the portions was then subjected to second cold rolling to a final thickness of 0.20 mm and subjected to decarburization and primary recrystallization annealing in an atmosphere of wet hydrogen. After an annealing separation agent consisting of MgO as a main component was coated on each of the sheets obtained, the sheet was wound into a coil, subjected to secondary recrystallization during temperature rise, subjected to final finish annealing at 1200° C. for 10 hours and then coated with a tension coating to form a product.

The magnetic properties of each of the products are also shown in Table 6.

Table 6 reveals that the products of Experiments Nos. 17 and 20 in which the conditions of intermediate annealing are within the range of the present invention have excellent magnetic properties, as compared with the products of Experiments Nos. 18, 19 and 21 in which the conditions are beyond the range of the invention.

TABLE 6

| Experiment Nos. | Condition of Intermediate Annealing Temperature (°C.) | Soaking Time (sec) | Magnetic Properties $B_8$ (T) | $W_{17/50}$ (W/kg) |
|---|---|---|---|---|
| 17 | 1000 | 40 | 1.932 | 0.77 |
| 18 | 1000 | 90* | 1.893 | 0.98 |
| 19 | 1100* | 30 | 1.895 | 0.93 |
| 20 | 950 | 45 | 1.926 | 0.80 |
| 21 | 875* | 45 | 1.884 | 1.02 |

Note)
Experiment Nos. 17 and 20: Examples of this invention
Experiment Nos. 18, 19 and 21: Comparative Examples
*beyond the range of the invention

EXAMPLE 6

Five slabs each having the composition A shown in Table 1 were heated to a temperature of 1370° C. and then subjected to rough rolling and final rolling by the same method as in Example 1 with the exception that the amount of cooling water for the work rolls of the first stand was gradually decreased. The temperatures of the head and tail portions of each of the resulting coils on the inlet side of finish rolling were 1142° to 1148° C. and 1078° to 1088° C., respectively. The surface temperature of the work rolls of the first stands immediately before contact with the material to be rolled was shown in Table 7.

Each of the resultant hot-rolled coils was annealed at 100° C. for 15 seconds, subjected to cold rolling to a thickness of 0.50 mm and then subjected to intermediate annealing at 1000° C. for 20 seconds. Each of the coils was then subjected to second cold rolling to a final thickness of 0.18 ram, and then to decarburization and primary recrystallization annealing in an atmosphere of wet hydrogen. After an annealing separation agent consisting of MgO as a main component was coated on each of the sheets obtained, the sheet was wound into a coil, subjected to secondary recrystallization during temperature rise, subjected to final finish annealing at 1200° C. for 10 hours and then coated with a tension coating to form a product.

The magnetic properties of each of the thus-obtained products are shown in Table 7.

Table 7 reveals that the products of Experiments Nos. 22 to 24 in which the surface temperature of the work rolls of the first stand of the hot finish rolling mill immediately before contact with the material to be rolled was within the range of the present invention have excellent magnetic properties as compared with the products of Experiments Nos. 25 and 26 in which the surface temperature was beyond the range of the invention.

EXAMPLE 7

A slab having the composition H shown in Table 1 was heated to a temperature of 1420° C. and then subjected to hot rolling by the same method as that in Example 1 to form a hot-rolled coil having a thickness of 2.0 mm. The temperatures of the head and tail portions on the inlet side of hot finish rolling were 1140° C. and 1075° C., respectively. The surface temperatures of the upper and lower sides of the work rolls of the first stand immediately before contact with the material to be rolled were 75° C. and 82° C., respectively The resulting coil was subjected to cold-rolling to a thickness of 1.10 mm, annealed at 950° C. for 40 seconds, and then subjected to cold-rolling to a thickness of 0.27 min. The coil was then annealed at 975° C. for 30 seconds, subjected to cold rolling to a final thickness of 0.10 mm and then subjected to decarburization and primary recrystallization annealing in an atmosphere of wet hydrogen. After an annealing separation agent consisting of MgO as a main component was coated on the sheet obtained, the sheet was subjected to secondary recrystallization during temperature rise, subjected to final finish annealing at 1200° C. for 10 hours, and then coated with a tension coating to form a product.

The magnetic properties of the thus-obtained product were extremely good; $B_8$ was 1,894 T and $W_{17/50}$ was 0.69 W/kg.

TABLE 7

| Experiment No. | Tamperature of First Stand Roll (°C.) Upper/Lower | Magnetic Properties $B_8$ (T) | $W_{17/50}$ (W/kg) |
|---|---|---|---|
| 22 | 68/73 | 1.925 | 0.75 |
| 23 | 78/89 | 1.926 | 0.76 |
| 24 | 83/95 | 1.923 | 0.77 |
| 25 | 96/105* | 1.915 | 0.84 |
| 26 | 124*/132* | 1.912 | 0.97 |

Experiment Nos. 22 to 24: Examples of this invention
Experiment Nos. 25 and 26: Comparative Examples
*beyond the range of the invention The present invention is capable of stably obtaining a grain oriented silicon steel thin sheet having very excellent magnetic properties.

Particularly, the invention enables the formation of a steel sheet having a final thickness of about 0.10 to 0.25 mm and excellent magnetic properties having iron loss values $W_{17/50}$ of about 0.84 W/kg or less.

What is claimed is:

1. In a method of producing a grain oriented silicon steel thin sheet having excellent magnetic properties, wherein a silicon steel slab is provided containing inhibitor-forming amounts of Cu, Se and Sb and is hot-rolled to form a hot-rolled sheet, the steps which comprise cold rolling said sheet at least twice including intermediate annealing to form a cold-rolled sheet having a final thickness of about 0.10 to 0.25 mm, decarburization and primary recrystallization annealing of said silicon steel sheet, and then final finish annealing said silicon steel sheet in a hot finish rolling mill which has an inlet side and a first stand positioned immediately before contact with said silicon steel sheet, wherein:

(a) the temperature of the material to be rolled at said inlet of said hot finish rolling mill is about 100° to 1150° C.;

(b) the surface temperature of the work rolls of said first stand is about 100° C. or less;

(c) the total rolling reduction of said hot finish rolling step is about 93 to 97%;

(d) said intermediate annealing is effected at a temperature of about 900° to 1150° C. within a time of about 50 seconds; and (e) the rolling reduction of said final cold rolling step is about 50 to 80%.

2. A production method according to claim 1, wherein the rolling reduction of the first pass of said hot finish rolling is at least about 40%.

3. The method defined in claim 1 wherein the amounts of said Cu, Se and Sb are about as follows:

Cu: 0.03–0.3%
Se: 0.01–0.06%
Sb: 0.005–0.20%.

4. The method defined in claim 1 wherein the temperature rise of said intermediate annealing is completed within about one minute or less.

* * * * *

UNITED STATES PATENT AND TRADEMARK OFFICE

CERTIFICATE OF CORRECTION

PATENT NO. : 5,330,586

DATED : July 19, 1994

INVENTOR(S) : Michiro Komatsubara et al

It is certified that error appears in the above-indentified patent and that said Letters Patent is hereby corrected as shown below:

In Column 1, line 23, please delete "<100>" and substitute --<001>--.

In Column 11, line 50, after "of" insert --45--.

In Column 13, line 28, delete "min" and substitute --mm--.

In Column 14, line 30, delete "ram" and substitute --mm--;
line 64, delete "min" and substitute --mm--.

In Column 16, line 13, delete "100°" and substitute --1000°--.

Signed and Sealed this

Twenty-seventh Day of September, 1994

*Attest:*

Bruce Lehman

BRUCE LEHMAN

*Attesting Officer*

*Commissioner of Patents and Trademarks*